US006427404B1

(12) United States Patent
Hageman

(10) Patent No.: US 6,427,404 B1
(45) Date of Patent: Aug. 6, 2002

(54) BASE SHEET FOR RETROFITTING EXISTING ROOFING

(75) Inventor: John P. Hageman, Closter, NJ (US)

(73) Assignee: Palisades Atlantic Corporation, Ridgefield Park, NJ (US)

( * ) Notice: Subject to any disclaimer, the term of this patent is extended or adjusted under 35 U.S.C. 154(b) by 0 days.

(21) Appl. No.: 09/464,755

(22) Filed: Dec. 16, 1999

Related U.S. Application Data

(60) Provisional application No. 60/113,791, filed on Dec. 22, 1998.

(51) Int. Cl.[7] ..... E04C 1/00

(52) U.S. Cl. ..... 52/309.4; 52/309.9; 52/746.11; 52/408

(58) Field of Search ..... 52/408, 410, 309.4, 52/309, 309.9, 746.1, 746.11, 309.8, 309.1

(56) References Cited

U.S. PATENT DOCUMENTS 3,763,614 A * 10/1973 Hyde et al. ..... 52/309
4,037,013 A * 7/1977 Sprague ..... 428/310
4,073,997 A * 2/1978 Richards et al. ..... 428/285
4,267,678 A * 5/1981 Carroll ..... 52/302
4,450,663 A * 5/1984 Watkins ..... 52/309.4
4,683,696 A * 8/1987 Thoeny ..... 52/247
4,747,247 A * 5/1988 Petersen, Jr. et al. ..... 52/408
5,088,249 A * 2/1992 Marzouki ..... 52/232
5,232,530 A * 8/1993 Malmquist ..... 52/309.9
5,600,929 A * 2/1997 Morris ..... 52/309.8
5,950,383 A * 9/1999 Williamson et al. ..... 52/408

* cited by examiner

*Primary Examiner*—Beth A. Stephan
(74) *Attorney, Agent, or Firm*—Ostrolenk, Faber, Gerb & Soffen, LLP

(57) ABSTRACT

A base sheet for use in retrofitting a new roof over an existing roof includes a polyester support sheet having a layer of flexible foam laminated thereto. The base sheet is laid over the existing roofing, with the foam layer in contact with the existing roofing. A new roofing is then laid over the base sheet.

10 Claims, 1 Drawing Sheet

BASE SHEET FOR RETROFITTING EXISTING ROOFING

CROSS REFERENCE TO RELATED APPLICATION

This application is based on Provisional Application Serial No. 60/113,791, entitled "Base Sheet For Retrofitting", filed Dec. 22, 1998

BACKGROUND OF THE INVENTION

The present invention relates to roof retrofitting, that is, replacing an existing roof with a new roof and, more particularly, relates to a base sheet for use in such retrofitting.

In the past, in order to retrofit certain types of roofs, such as gravel surfaced roofs, it has been necessary to either scrape the roofs smooth or lay a relatively rigid insulation or recovery board over the roof. Either of these approaches has proven to be time consuming and costly. In addition, when the roof is not scraped clean, the presence of gravel under the new roof can sometimes be visually apparent thereby impairing the aesthetics of the roof.

SUMMARY OF THE INVENTION

It is an object of the present invention to retrofit new roofing to existing roofing in a faster, more economical and more efficient manner without impairing the aesthetics of the new roofing.

The foregoing and other objects of the invention are achieved by employing a base sheet which includes a layer of flexible foam laminated to a support sheet.

The flexible foam cushions the underlying gravel, thus, preventing it from cutting through the new roofing and causing any leakage. Further, the flexible foam drapes over the gravel hiding it from sight, thereby resulting in a more aesthetic roof.

Other features and advantages of the present invention will become apparent from the following description of the invention which refers to the accompanying drawings.

DETAILED DESCRIPTION OF THE PREFERRED EMBODIMENT(S)

Figure 1:
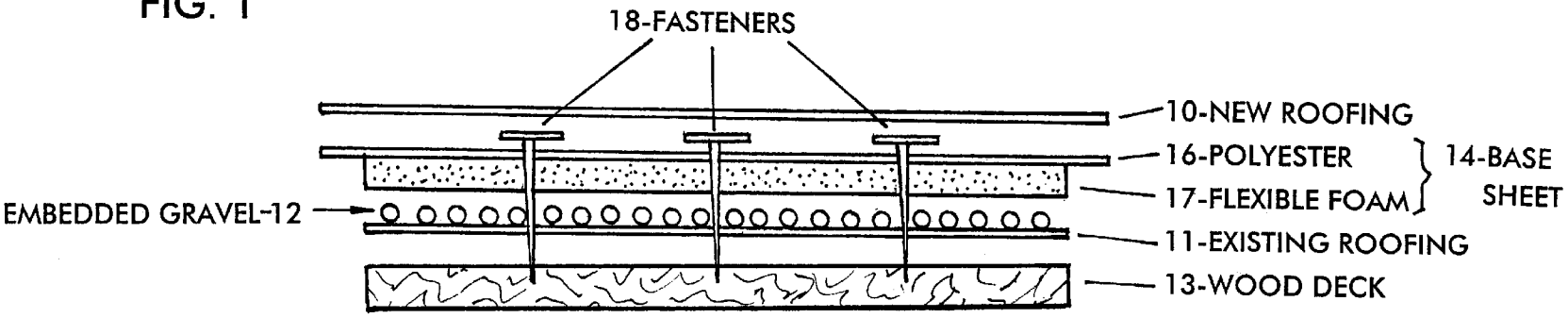
FIG. 1 is a sectional view of a retrofitted roof in accordance with a first embodiment of the invention.

Referring to FIG. 1, there is shown a first embodiment of the invention in which a new roofing 10 is to be installed over an existing roofing 11. The existing roofing 11, which includes embedded gravel 12, is installed on a wood deck 13. It should be noted that the existing roofing 11 is shown in FIG. 1 after it has been swept clean of any loose gravel. Accordingly, the only gravel shown in FIG. 1 is embedded gravel 12.

In accordance with the invention, a base sheet 14 comprising a support sheet 16 having a layer of flexible foam 17 laminated thereto is laid over the existing roofing.

Preferably, the support sheet 16 is polyester of a weight ranging from 100 grams per square meter to 300 grams per square meter and having a thickness ranging from ⅛" to 1½".

Preferably, the flexible foam layer 17 is ⅛" to ½" thick.

The base sheet 14 is laid over the existing roofing 11 with the flexible foam layer 17 in contact with the embedded gravel 12. The base sheet 14 is then fastened through the existing roof 11 to the deck 10 using suitable fasteners 18. Thereafter, the new roofing 10, which may be a built up roofing or a membrane sheet(s) is installed over the base sheet 14 in a conventional manner.

Figure 2:
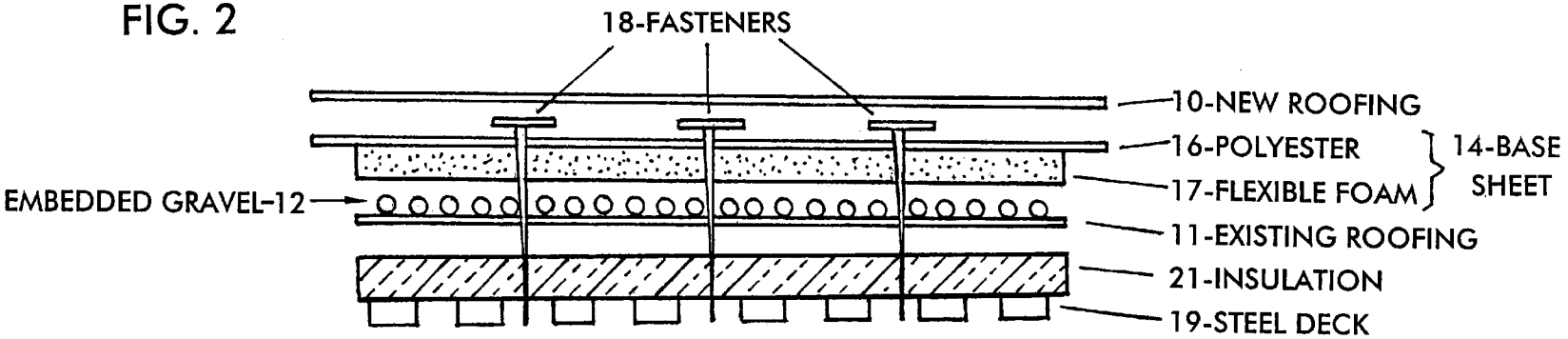
FIG. 2 is a sectional view of a retrofitted roof in accordance with a second embodiment of the invention.

FIG. 2 shows a second embodiment of the invention in which the base sheet 14 and the new roofing 10 is installed over existing roofing 11 on a steel deck 19 via an intermediate insulation layer 21. Installation of the base sheet 14 on the existing roofing 11 in FIG. 2 is the same as that in FIG. 1 except that the base sheet 14 is fastened through the existing roof 11 to the insulation layer 21 rather than to the steel deck 19.

The new base sheet 14 allows a work crew to reproof gravel surfaced roofs 11 faster with less cost overall than either scraping the roof smooth or of laying a recovery board over the roof. Further, the flexible foam 17 cushions the embedded gravel 12, thus preventing it from cutting through the new roofing 10 and causing leakage. This is a common occurrence in prior art retrofitted roofs that consist of a base sheet and a roof membrane over a swept gravel roof. Further, the presence of gravel under a new roof can sometimes be visually apparent, i.e., the gravel impressions show on the new roof. In accordance with the present invention, the cushioning of the gravel by the flexible foam prevents such impressions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A retrofitted roof assembly, comprising:

a deck;

an existing roofing on the deck;

a base sheet comprised of a support sheet having a flexible foam layer on the existing roofing, the base sheet being disposed on the existing roofing such that the flexible foam layer contacts the existing roofing; and a new roofing on the base sheet, the new roofing being disposed on the base sheet such that the new roofing is in contact with the support sheet.

2. A retrofitted roof assembly in accordance with claim 1, wherein the support sheet is made of polyester.

3. A retrofitted roof assembly in accordance with claim 1, wherein the existing roofing includes an embedded gravel surface.

4. A retrofitted roof assembly in accordance with claim 3, wherein the support sheet is made of polyester.

5. A retrofitted roof assembly in accordance with claim 4, wherein the deck is made of wood.

6. A retrofitted roof assembly in accordance with claim 4, wherein the deck is made of steel.

7. A method of retrofitting new roofing on an existing roofing, comprising:

placing a base sheet over the existing roofing, the base sheet comprising a support sheet having a flexible foam layer laminated thereto, the base sheet being placed over the existing roofing such that the flexible foam layer is in contact with the existing roofing; and placing the new roofing over the base sheet such that the new roofing is in contact with the support sheet.

8. A method of retrofitting new roofing on an existing roofing in accordance with claim 7, wherein the support sheet is made of polyester.

9. A method of retrofitting new roofing on an existing roofing in accordance with claim 7, wherein the existing roofing includes a gravel surface and further comprising sweeping the gravel surface to remove loose gravel therefrom.

10. A method of retrofitting new roofing on an existing roofing in accordance with claim 9, wherein the support sheet is made of polyester.

* * * * *